US005251335A

United States Patent [19]

DeFusco

[11] Patent Number: 5,251,335

[45] Date of Patent: Oct. 12, 1993

[54] GOLF GLOVE

[75] Inventor: Ralph DeFusco, North Kingston, R.I.

[73] Assignee: Tretorn AB, Helsingborg, Sweden

[21] Appl. No.: 822,471

[22] Filed: Jan. 17, 1992

[51] Int. Cl.[5] ..... A41D 19/00

[52] U.S. Cl. ..... 2/163; 2/169

[58] Field of Search ..... 2/159, 161 A, 161 R, 2/163, 169, 16, 20

[56] References Cited

U.S. PATENT DOCUMENTS

| | | | |
|---|---|---|---|
| 1,149,139 | 8/1915 | Heagle | 2/161 A X |
| 2,148,849 | 2/1939 | Blewer | 2/159 |
| 2,344,477 | 3/1944 | Wells, Jr. | 2/159 |
| 2,459,985 | 1/1949 | Woodbury | 2/159 X |
| 2,708,753 | 5/1955 | Kennedy | 2/159 |
| 2,907,046 | 10/1959 | Scherr | 2/159 |
| 3,597,765 | 8/1971 | Stanton | 2/159 |
| 4,663,784 | 5/1987 | Ash | 2/159 X |

*Primary Examiner*—Clifford D. Crowder
*Assistant Examiner*—Sara M. Current
*Attorney, Agent, or Firm*—Donald Brown

[57] ABSTRACT

A golf glove of man-made (synthetic) material and two leather sections, wherein a first leather section is positioned on the palm side of the golf glove and extends from the three of the outer fingers down into a heel and a separate leather thumb portion is also positioned on the palm side of the glove.

The backside of the golf glove, as well as the other portions of the glove on the palm side are of synthetic material, e.g., plastic.

8 Claims, 1 Drawing Sheet

GOLF GLOVE

BACKGROUND OF THE INVENTION

This invention is directed to a new and improved golf glove. One golf glove is usually worn by golfers on their left hand by a right handed golfer and on their right hand by a left handed golfer.

The glove is used to give the golfer better control of the golf club, as well as to protect the hand.

The present invention is to a new and improved golf glove that is in part of man-made (synthetic) material and which has two strategically located leather material parts. The golf glove is designed to provide added feel in certain of the fingers, as well as to protect the key wear and stress points on the thumb and heel of the palm side of the glove.

BRIEF DESCRIPTION OF THE INVENTION

The GOLF GLOVE of this invention is designed to provide great "last three finger grip control", as well as provide protection against wear and stress in a glove. The above is accomplished even though a major portion of the palm side of the glove is constructed of lower cost man-made (synthetic) material, in lieu of leather.

The golf glove is provided with two separate leather sections located on the palm side of the glove coupled to the synthetic portions of the glove. One of the leather sections extends from the finger tips of the last three fingers on the palm facing side of the glove to the heel of the glove, while the other leather section is part of the palm facing thumb of the glove and extends from the end of the thumb to the heal of the palm. Both leather sections are coupled to synthetic material (such as plastic), preferably by being sewn to the synthetic material.

DETAILED DESCRIPTION OF THE INVENTION

Figure 1:
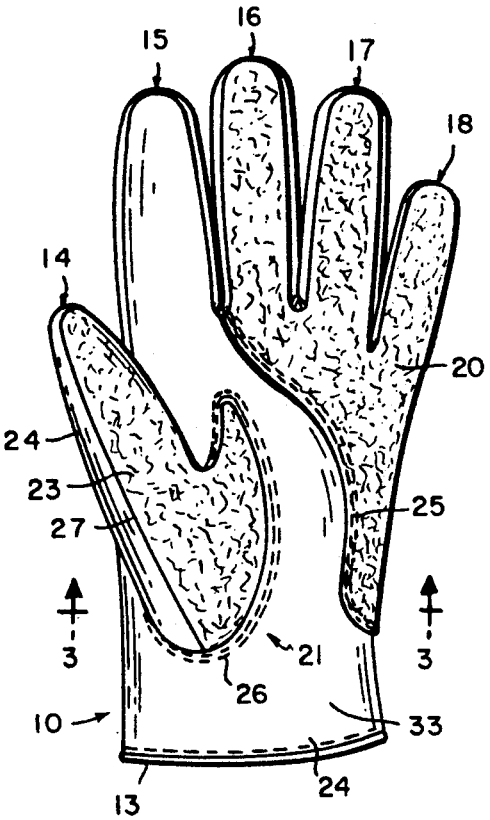
FIG. 1 is a top view of the golf glove of this invention showing the palm side of the glove.
Figure 2:
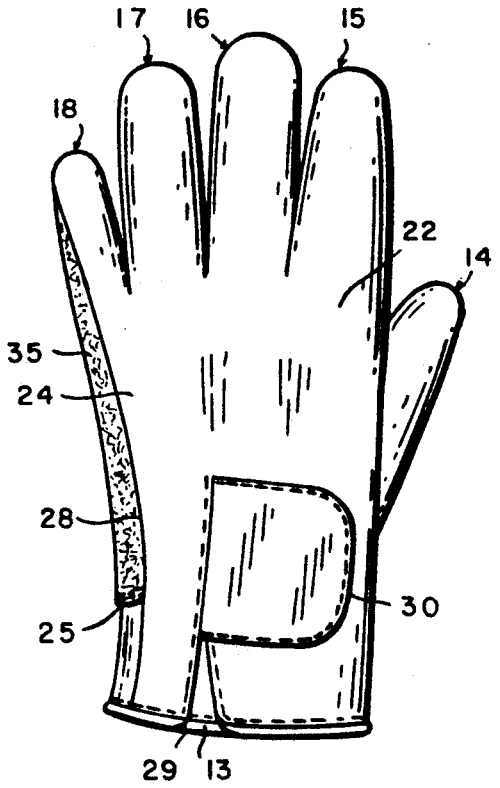
FIG. 2 is a view of the backside of the glove of FIG. 1.
Figure 3:
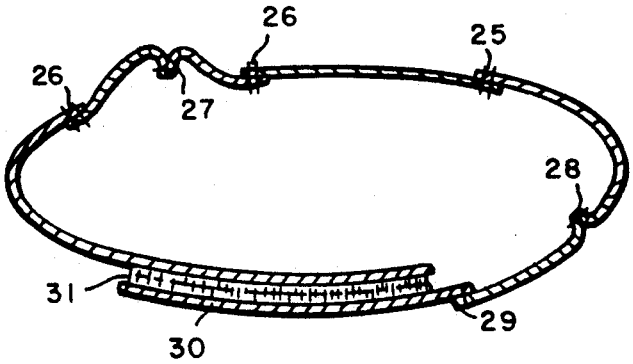
FIG. 3 is a sectional view taken along line 3—3 of FIG. 1.

Reference should now be had to FIGS. 1 through 3 for a detailed description of the golf glove of this invention.

The golf glove is shown at 10 and comprises a palm side 21 and a back (rear) side 22.

The glove comprises two leather sections 20 and 23 with the remainder of the palm side 21 and the back side 22 being of man-made (synthetic) material 24. The leather section 20 is stitched at 25 and 28 to the man-made material 24, and the leather section 23 is stitched at 26 and 27 to the man-made material 24.

The leather section 20 extends as shown on the palm side (see FIG. 1) from the tips of the three outer fingers 16, 17 and 18 to the heel 33 of the glove palm side 21. The index finger 15 of the glove is not of leather as shown. The side 35 of the pinky finger portion of the glove and a portion of the hand is of leather (see FIG. 2).

The leather section 23, which is separated from the leather section 20 extends from the man-made material from the tip of the thumb to the heel 33 of the glove.

The back side of the thumb is also of man-made material (synthetic) 24 and is part of the backside of the glove.

The preferred man-made (synthetic) material is polyurethane coated nylon or such synthetic materials sold under the trademarks SPANDEX and LYCRA. The leather is preferably cowhide.

The glove is open at the bottom cuff 13 and is split in the back. A flap 30 having a Velcro TM type closure 31 is preferably incorporated in the glove. However, this is not a feature of the invention, since closure may be made using snaps and etc.

We claim:

1. A golf glove comprising a thumb stall, an index finger stall, a pinky stall having an outer side and a third and fourth finger stalls positioned between said index finger stall and said pinky finger stall, a palm side of said glove, having a heel portion said palm of said glove comprising man-made material and first and second non-synthetic leather sections, said first leather section forming the pinky and third and fourth finger stalls on the palm of the glove and extending to the heel of the palm of the glove and forming a part of the palm side of the glove and said index finger stall on said palm side of said glove being entirely of man-made material and said second lather section is separated from said first leather section and forms the thumb stall on the palm side of the glove, the backside of said thumb and the backside of the finger stalls of the glove being of man-made material.

2. The golf glove of claim 1, in which said first and second leather sections are stitched to said man-made material.

3. The glove of claim 2, in which the man-made material is plastic.

4. The golf glove of claim 1, in which the man-made material comprises a separate thumb portion stitched about an opening in the man-made material.

5. The glove of claim 4, in which the man-made material is plastic.

6. The glove of claim 1, in which the man-made material is plastic.

7. The glove of claim 1, in which said man-made material is polyurethane coated nylon.

8. The glove of claim 1, in which the pinky finger outer side portion of such glove is of leather.

* * * * *